US005788531A

United States Patent [19]

Wright et al.

[11] Patent Number: 5,788,531

[45] Date of Patent: Aug. 4, 1998

[54] CONNECTOR ALIGNMENT GUIDE

[75] Inventors: John O. Wright, York; Patricia M. Reagan, Hummelstown, both of Pa.

[73] Assignee: Osram Sylvania Inc., Danvers, Mass.

[21] Appl. No.: 499,881

[22] Filed: Jul. 11, 1995

[51] Int. Cl.[6] ..... H01R 13/629; H01R 13/74

[52] U.S. Cl. ..... 439/374; 439/544; 439/557; 248/56

[58] Field of Search ..... 439/374, 527, 439/533, 544, 557; 248/56, 65

[56] References Cited

U.S. PATENT DOCUMENTS

| | | | |
|---|---|---|---|
| 2,362,160 | 11/1944 | Robertson | 248/56 |
| 3,285,551 | 11/1966 | Tschanz | 248/56 |
| 4,358,079 | 11/1982 | Navarro | 248/56 |
| 4,630,330 | 12/1986 | Keller et al. | 248/56 |
| 4,673,010 | 6/1987 | Prufer et al. | 141/384 |
| 4,721,480 | 1/1988 | Yung | 439/527 |
| 5,276,280 | 1/1994 | Ball | 248/56 |
| 5,522,735 | 6/1996 | Wright | 439/540.1 |

FOREIGN PATENT DOCUMENTS

| | | | |
|---|---|---|---|
| 7413427 | 11/1974 | Netherlands | 248/56 |
| 1773305 | 10/1992 | U.S.S.R. | 439/374 |

*Primary Examiner*—Gary F. Paumen
*Attorney, Agent, or Firm*—William H. McNeill

[57] ABSTRACT

A connector alignment guide is provided which prevents inadvertent rotational movement of a male connector relative to a female connector and allows for connection of such connectors in a predetermined fixed orientation. The connector alignment guide includes a tubular segment having an open region at one end through which extends a bent or curved portion of a cable and a cable clamp associated with a respective connector. Such bent or curved portion engages edges which form the boundary of such open region to prevent such rotation and provide such fixed orientation.

12 Claims, 4 Drawing Sheets

CONNECTOR ALIGNMENT GUIDE

BACKGROUND OF THE INVENTION

1. Field of the Invention

The present invention relates to a connector alignment guide for use with electrical connectors. More particularly, the present invention relates to a connector alignment guide for use with antenna connectors.

2. Description of the Prior Art

A typical antenna connector for an antenna cable such as those used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such prior art devices inadvertent rotational movement of the male connector body relative to the female connector body makes providing a satisfactory electrical connection difficult. In addition, satisfactory means for guiding such connectors together in a predetermined fixed orientation is lacking.

It is an object of the present invention to provide a connector wherein the male connector body does not inadvertently move in a rotational direction relative to the female connector body.

It is another object of the present invention to provide male and female connectors which include means for guiding such connectors together in a predetermined fixed orientation.

DISCLOSURE OF THE INVENTION

This invention achieves these and other objects by providing a connector alignment guide comprising a segment extending along a longitudinal axis and having a first end, an opposite second end, an inner surface defining a bore which extends from the first end to the opposite second end, and an outer surface. An open region is provided at the first end and extends through the segment from the outer surface to the inner surface. A coupler is provided at the opposite second end.

BRIEF DESCRIPTION OF THE DRAWINGS

This invention may be clearly understood by reference to the attached drawings in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
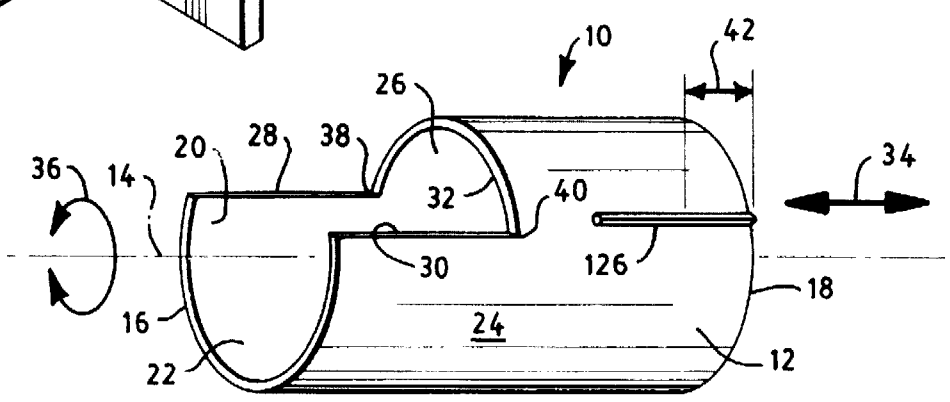
FIG. 1. is a perspective view of a connector alignment guide embodying the present invention.
Figure 2:
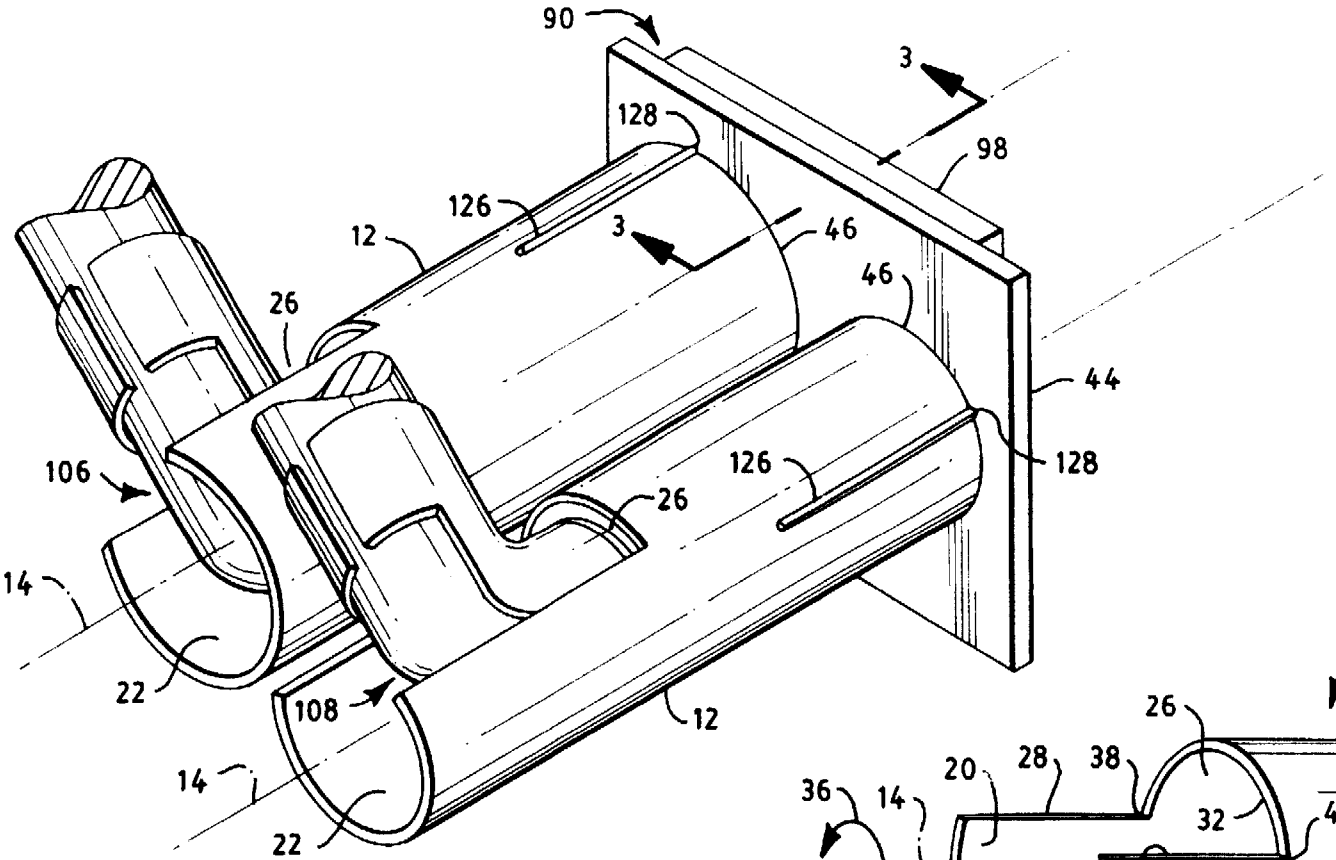
FIG. 2 is a perspective view of two connector alignment guides of FIG. 1 in use.
Figure 3:
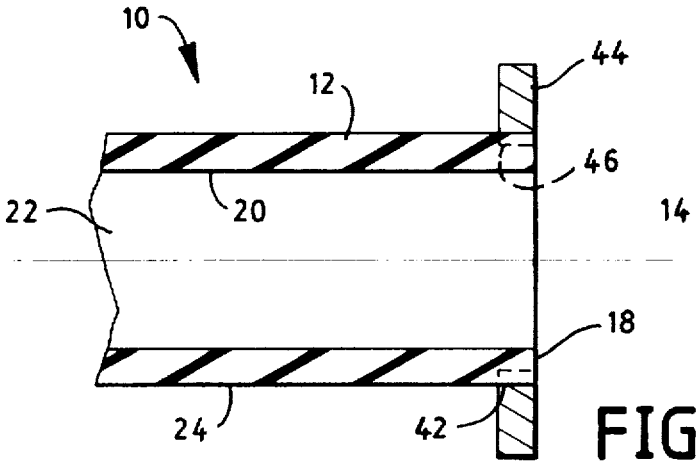
FIG. 3 is a sectional view of FIG. 2 along lines 3—3 with element 90 removed for clarity.

The embodiment of this invention which is illustrated in FIGS. 1 to 3 is particularly suited for achieving the objects of this invention. FIG. 1 depicts a connector alignment guide 10 which comprises a segment 12 which extends along a longitudinal axis 14. In the embodiment of FIGS. 1 to 3, the segment 12 is a tubular segment. The segment 12 has a first end 16, opposite second end 18 and an inner surface 20 which defines a bore 22 which extends from end 16 to end 18. The segment 12 also has an outer surface 24. In the preferred embodiment, the segment 12 is fabricated from a plastic material.

The connector alignment guide 10 also comprises an open region located at end 16. Generally, such open region will be provided by eliminating a portion of the segment 12 at end 16. In the embodiment of FIGS. 1 to 3, an open region 26 is provided at end 16. The open region 26 extends through the segment 12 from outer surface 24 to inner surface 20. In the embodiment of FIG. 1, the open region 26 is bounded by an edge of the tubular segment 12. Such edge comprises a first length 28, a second length 30 and a third length 32. Length 28 extends in the direction 34 of the longitudinal axis 14 from end 16 towards end 18. Length 30 is spaced from length 28 in a circumferential direction 36 relative to longitudinal axis 14 and extends in the direction 34 of longitudinal axis 14 from end 16 towards end 18. Length 32 is positioned between ends 16 and 18 and extends from length 28 to length 30. Although not necessary, in the embodiment of FIG. 1, length 32 extends in circumferential direction 36 from a distal end 38 of length 28 to a distal end 40 of length 30.

The connector alignment guide 10 also comprises a coupler at end 18 of the segment 12. The coupler is provided so that the segment 12 can be mounted to a support structure such as, for example, a radio housing. In one form, the coupler merely comprises one or more lengths of the outer surface 24 adjacent end 18. For example, in the embodiment of FIGS. 1 to 3, the coupler comprises a length 42 of outer surface 24 adjacent end 18. With reference to FIG. 3, the segment 12 is coupled to a rear surface 44 of a radio by inserting the length 42 into an aperture 46 in such rear surface. By dimensioning the outer diameter of the length 42 to be slightly more than the inner diameter of aperture 46, a press-fit may be effected between segment 12 and rear surface 44, as the length 42 is inserted into aperture 46, in a conventional manner. An adhesive may be used in place of or in addition to the press-fit, if desired. In the preferred embodiment, axis 14 and segment 12 will extend from rear surface 44 at 90° as depicted in FIG. 3 for use as described herein.

Figure 4:
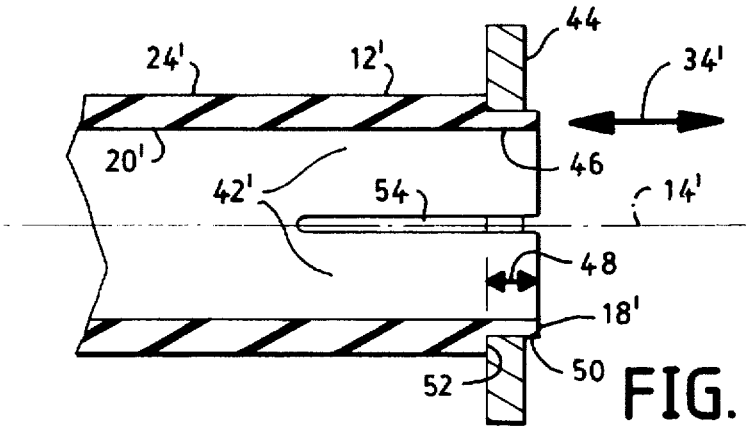
FIG. 4 is a sectional view of an alternative embodiment similar to the sectional view of FIG. 3.
Figure 5:
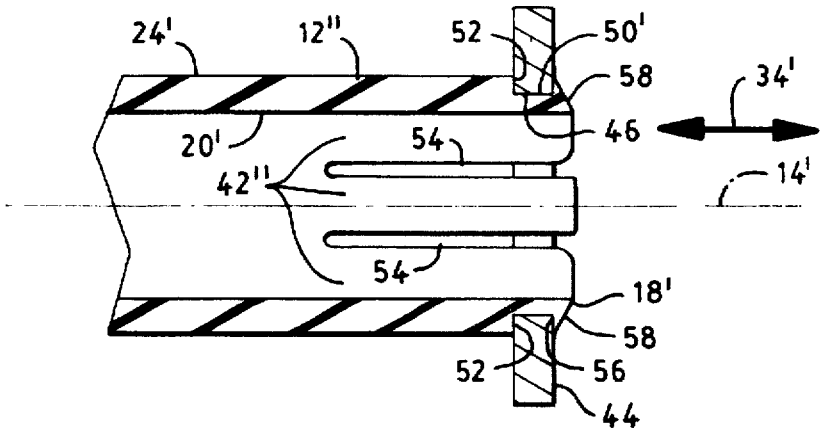
FIG. 5 is a sectional view of an alternative embodiment similar to the sectional view of FIG. 3.

FIGS. 4 and 5 depict some alternative embodiments of the segment of the present invention. Each segment of FIGS. 4 and 5 is identical to segment 12 of FIGS. 1 to 3 with the exception of the coupler. In the embodiment of FIG. 4, a segment 12' is provided which includes a coupler which comprises more than one length of the outer surface of the segment. As shown in FIG. 4, the coupler comprises a plurality of lengths 42' of outer surface 24'. Each length 42' comprises a recessed segment 48 of the outer surface 24' adjacent end 18'. Each recessed segment 48 includes a base surface 50 which extends in the direction of longitudinal axis 14' of segment 12' to a stop surface 52 which is located between the ends of the segment. In the embodiment of FIG. 4, each length 42' is spaced from an adjacent length 42' by an elongated aperture 54 which extends from an outer surface 24' of said segment 12' to an inner surface 20' and in the direction 34' of axis 14'. Segment 12' may be coupled to rear surface 44 in the same manner as segment 12 of FIGS. 1–3. In the embodiment of FIG. 4, effecting a press fit will be facilitated by the resilience of each length 42'.

The embodiment of FIG. 5 is similar to the embodiment of FIG. 4, and like elements are designated by like reference numerals. Referring to segment 12", the embodiment of FIG. 5 may be distinguished from the embodiment of FIG. 4 to the extent that base surface 50 is replaced by a base surface 50' which extends from the stop surface 52 to an opposite stop surface 56 located between the stop surface 52 and end 18' of the segment 12". In addition, each length 42" comprises a beveled portion 58 which extends away from longitudinal axis 14' from end 18' to stop surface 56. In the embodiment of FIG. 5, the coupling of the segment 12" to the rear surface 44 is facilitated as a result of the camming effect between the beveled portion 58 and the surface which defines aperture 46 as the end 18' of the segment 12" is inserted into the aperture 46. When fully inserted, each resilient length 42" will snap away from axis 14' such that the portion of the rear surface 44 adjacent aperture 46 will bear against base 50' and stop surfaces 52 and 56 to hold the segment 12" in place.

Figures 6, 7:
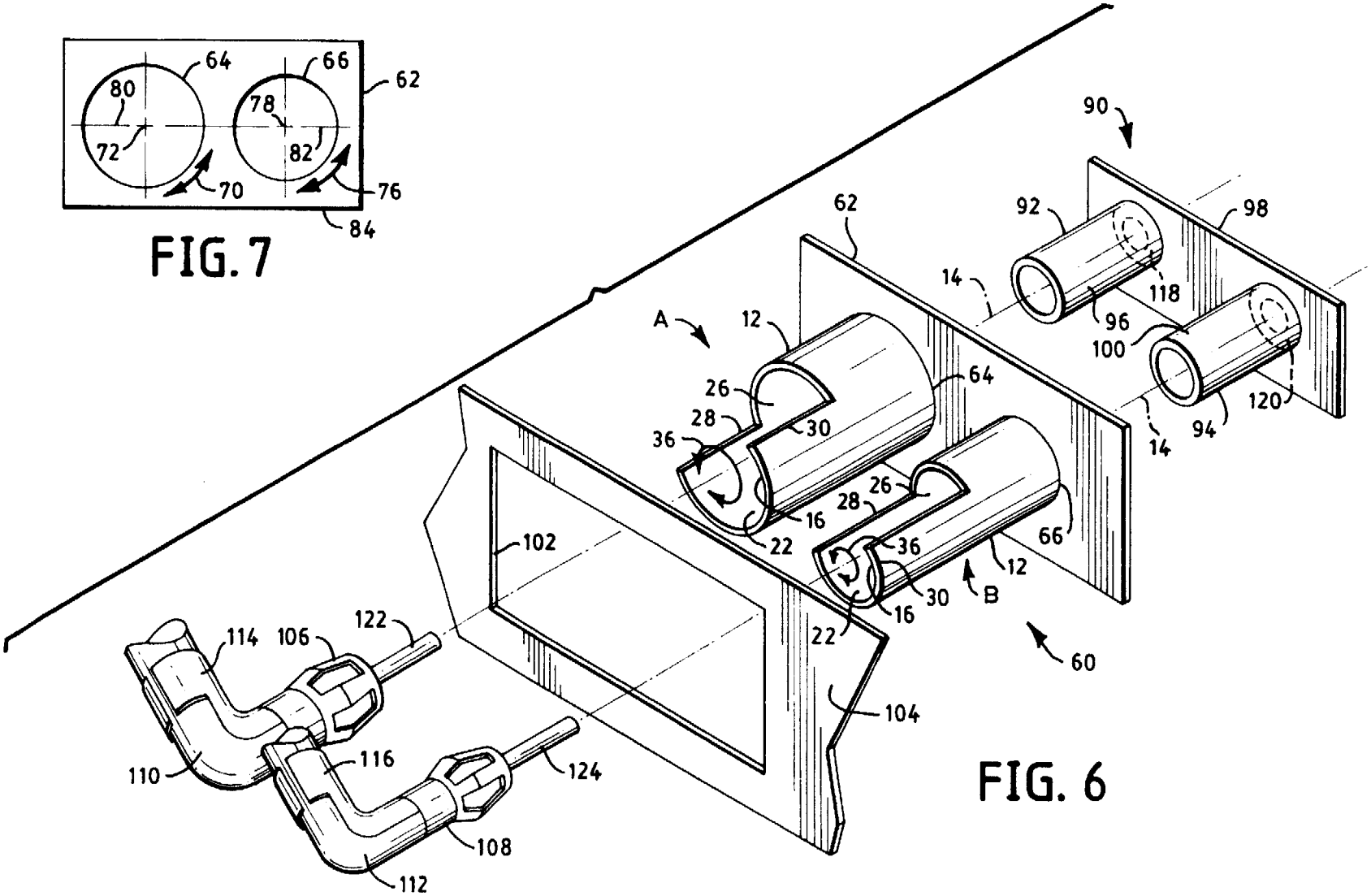
FIG. 6 is a exploded view of an alternate embodiment of the present invention.
FIG. 7 is a plan view of element 62 of FIG. 6.

FIGS. 6 and 7 depict an alternative embodiment of the connector alignment guide of the present invention. In particular, FIG. 6 depicts a connector alignment guide 60 which comprises a coupler in the form of a support member 62. Support member 62 is a plate-like structure having a first aperture 64 and a second aperture 66 extending therethrough. The connector alignment guide 60 includes two segments 12 similar to segment 12 of FIGS. 1 to 3 and like elements are designated by like reference numerals. For an understanding of segments 12 of FIGS. 6 and 7, reference is made to the discussion herein of segment 12 of FIGS. 1 to 3. It should be noted that segments 12 of FIG. 6 may be attached to support member 62 in the manner in which segment 12 of FIGS. 1 to 3 is attached to rear surface 44 or in the manner in which segments 12' and 12" of FIGS. 4 and 5 are attached to rear surface 44, or any other manner known in the art. Alternatively, segments 12 and support member 62 of FIG. 6 may be formed of a single piece of material in any conventional manner.

Segments 12 of FIG. 6 are identical to each other with the exception that the diameter of one is smaller than the diameter of the other, the larger segment 12 being designated A and the smaller segment B being designated B. Of course, segments A and B can be the same size if desired.

Figure 9:
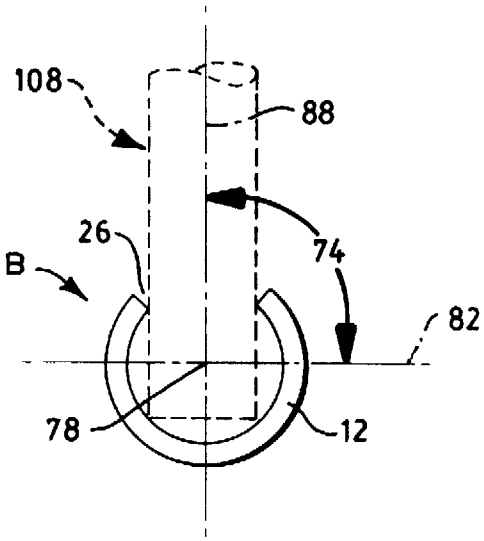
FIGS. 8 and 9 are diagrammatic elevational views of elements 12 attached to element 62.
Figure 8:
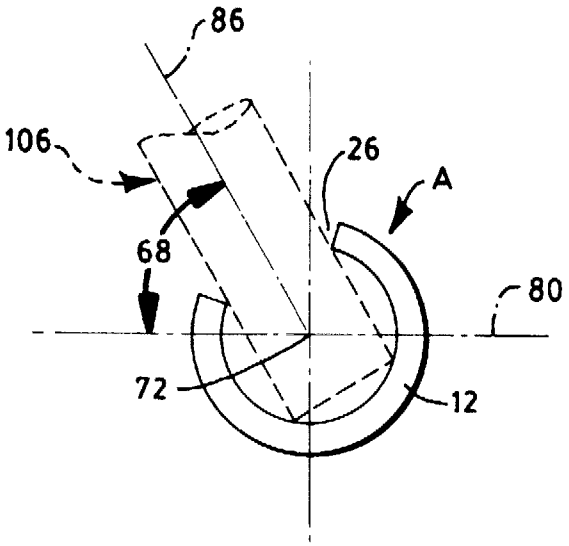

Although not necessary, in the embodiment of FIG. 6, each respective open region is oriented at an angle measured in a circumferential direction relative to a respective aperture in the support member. For example, and referring to FIGS. 7 to 9, open region 26 of segment A is oriented at an angle 68 measured in circumferential direction 70 relative to a horizontal axis 72 of aperture 64. Similarly, open region 26 of segment B is oriented at an angle 74 measured in a circumferential direction 76 relative to a horizontal axis 78 of aperture 66. Angles 68 and 74 are measured between a respective X-axis 80, 82 which extends through the center of apertures 64 and 66, respectively, and is parallel to an edge 84 of the support member 62, and a respective radial line 86, 88 which extends from such center and bisects a respective open region 26. In the preferred embodiment angles 68 and 74 will be different for reasons described herein.

In the embodiment of FIG. 6, the connector alignment guide 60 includes a connector member 90 which comprises a first connector 92 and a second connector 94. Connector 92 comprises an elongated portion 96 which is attached to a support member 98 and extends into bore 22 of segment A from the support member 62 towards an open region 26. Connector 94 comprises an elongated portion 100 which is also attached to support member 98 and extends into a bore 22 of segment B from support member 62 towards an open region 26.

In assembling the connector alignment guide 60 of FIG. 6, the segments A and B are inserted through an opening 102 in a rear surface 104, which may be, for example, the rear surface of a radio, until support member 62 engages rear surface 104. The support member 62 and rear surface 104 may then be attached to one another. The elongated portions 96 and 100 are then inserted into a bore 22 of a segment A and B, respectively, until support member 98 engages support member 62. The support members 62 and 98 may then be attached to one another.

In use, the connector alignment guide is used in combination with a male or female electrical connector, such as a typical antenna connector, in those applications wherein the end of the cable and the clamp means for attaching the cable to the connector are bent. For example, in the embodiment of FIG. 6, male antenna connectors 106 and 108 are connected to cables 110 and 112, respectively, by clamp means 114 and 116, respectively in the conventional manner. Without limitation the diameter of cable 110 is greater than the diameter of cable 112 and it is for this reason that the diameter of the bore 22 of segment A is greater than the diameter of the bore 22 of segment B. the cables 110, 112 and the clamp means 114, 116 are bent at about 90° although such bend may be more or less if desired. The connectors 92 and 94 include female connectors 118 and 120, respectively which are electrically and mechanically connected in a conventional manner to a circuit such as a circuit on a printed circuit board (not shown).

It will be apparent to those skilled in the art that female connectors 118 and 120 may be replaced with male connectors in which embodiment the male connectors 106, 108 will be replaced with female connectors connected to cables 110, 112 respectively, and such embodiment will function in the same manner as described herein regarding the embodiment of FIG. 6. In the embodiment of FIG. 6, when the connector alignment guide 60 is assembled as described herein, the male prongs 122 and 124 may be inserted into respective female connectors 118 and 120 by inserting male connectors 106 and 108 into segments 12 identified by A and B, respectively. The bent portion of the cables 110, 112 and respective clamp means 114, 116 will extend out of respective open regions 26. It will be apparent to those skilled in the art that the male connectors 106 and 108 can only be fully inserted into respective segments 12 in this manner. In particular, if the bent portions of the cable and clamp means are not in alignment with respective open regions 26, such bent portions will engage respective ends 16 of respective segments 12 to impede insertion of the male connectors into the female connectors. In this manner, means is provided for guiding male and female connectors together in a predetermined fixed orientation. When the male connector prongs 122, 124 have been fully inserted into the female connectors 118, 120 rotation of the male prongs 122, 124 in circumferential direction 36 will be impeded as a result of the engagement of the bent portions of respective cables and cable clamp means with edges 28 and 30 of respective open regions 26. This interrelationship between male connectors 106, 108 and respective segments 12 is depicted in FIG. 2 which depicts such male connectors fully inserted into respective segments 12. The embodiment of FIG. 2 may be distinguished from the embodiment of FIG. 6 in that FIG. 2 depicts two segments 12, including a larger segment A and smaller segment B attached directed to a rear surface 44 of a radio as described herein. In such embodiment, the support member 62 is not provided, and a support member 98 of a connector member 90, which includes elongated portions 96 and 100, is directly attached to the rear surface 44.

The segments 12 may be attached to the rear surface 44 or the support member 62 such that open regions 24 extend at predetermined angles 68, 74 by providing an aligner adjacent end 18 of the segments. For example, in the embodiment of FIG. 2, each segment 12 includes an aligner in the form of an elongated protuberance 126 which keys with a mating groove 128 which extends through the rear surface 44.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. In combination, a right angled electrical connector and a connector alignment guide therefor, said guide comprising:

a segment extending along a longitudinal axis and having a first end, an opposite second end, an inner surface defining a bore which extends from said first end to said opposite second end, and an outer surface;

a single open region at said first end extending through said segment from said outer surface to said inner surface; and a coupler at said opposite second end, said right angled connector having a first portion extending along said longitudinal axis and fitted within said bore and a second portion projecting at a right angle to said first portion and fitted within said open region.

2. The combination of claim 1 wherein said segment of said connector alignment guide is a tubular segment.

3. The combination of claim 2 wherein said open region of said connector alignment guide is bounded by an edge of said tubular segment, said edge comprising a first length extending in the direction of said longitudinal axis from said first end towards said opposite second end, a second length spaced from said first length in a circumferential direction relative to said longitudinal axis and extending in the direction of said longitudinal axis from said first end towards said opposite second end, and a third length positioned between said first end and said opposite second end and extending from said first length to said second length.

4. The connector alignment guide of claim 1 wherein said coupler comprises one or more length of said outer surface adjacent said opposite second end.

5. The connector alignment guide of claim 4 wherein each length of said one or more length comprises a recessed segment of said outer surface adjacent said opposite second end.

6. The connector alignment guide of claim 5 wherein said one or more length comprises a plurality of resilient recessed lengths, each recessed length of said plurality of recessed lengths being spaced from an adjacent recessed length by a respective elongated aperture which extends from said outer surface to said inner surfaces and in the direction of said longitudinal axis.

7. The connector alignment guide of claim 5 wherein each recessed segment comprises a base surface which extends in the direction of said longitudinal axis to a first stop surface located between said first end and said opposite second end.

8. The connector alignment guide of claim 6 wherein each recessed length of said plurality of recessed lengths comprises a base surface which extends in the direction of said longitudinal axis to a first stop surface located between said first end and said opposite second end.

9. The connector alignment guide of claim 7 wherein said base surface extends from said first stop surface to an opposite second stop surface located between said first stop surface and said opposite second end.

10. The connector alignment guide of claim 9 wherein each length of said one or more length comprises a beveled portion which extends away from said longitudinal axis from said opposite second end to said second stop surface.

11. The connector alignment guide of claim 10 wherein said one or more length comprises a plurality of resilient recessed lengths, each recessed length of said plurality of recessed lengths being spaced from an adjacent recessed length by a respective elongated aperture which extends from said outer surface to said inner surfaces and in the direction of said longitudinal axis.

12. The connector alignment guide of claim 1 further including at least one aligner adjacent to said opposite second end.

* * * * *

UNITED STATES PATENT AND TRADEMARK OFFICE

CERTIFICATE OF CORRECTION

PATENT NO. : 5,788,531

DATED : August 14, 1998

INVENTOR(S) : Inami, et. al.

It is certified that error appears in the above-identified patent and that said Letters Patent is hereby corrected as shown below:

Title page, item [30],

Please add the Foreign Application Priority Data

September 14, 1995 [JP] Japan ..... 7-237264

Signed and Sealed this

Twenty-fourth Day of August, 1999

*Attest:*

Q. TODD DICKINSON

*Attesting Officer*

*Acting Commissioner of Patents and Trademarks*